US007721386B2

(12) United States Patent
McKinney et al.

(10) Patent No.: US 7,721,386 B2
(45) Date of Patent: May 25, 2010

(54) CLOSER ARM ASSEMBLY FOR AN AUTOMATIC DOOR CLOSER

(75) Inventors: Patrick McKinney, Stevens, PA (US); Todd S. Beaton, Blandon, PA (US); B. Brian Lindemuth, Lititz, PA (US); Gerald R. Whitcomb, Denver, PA (US)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

(21) Appl. No.: 12/290,481

(22) Filed: Oct. 31, 2008

(65) Prior Publication Data

US 2009/0056072 A1 Mar. 5, 2009

Related U.S. Application Data

(62) Division of application No. 11/290,011, filed on Nov. 30, 2005, now Pat. No. 7,444,713.

(51) Int. Cl.
*E05F 3/00* (2006.01)

(52) U.S. Cl. ..... 16/63; 16/49

(58) Field of Classification Search ..... 16/61–65, 16/49, 59, 70–75, 78–80, 82, 85, DIG. 17; 292/DIG. 19, DIG. 17
See application file for complete search history.

(56) References Cited

U.S. PATENT DOCUMENTS

| | | | | |
|---|---|---|---|---|
| 1,024,465 | A * | 4/1912 | Voight | 16/49 |
| 2,797,117 | A | 6/1957 | Seay et al. | |
| 3,259,936 | A | 7/1966 | Sheridan | |
| 3,860,993 | A | 1/1975 | Matuska | |
| 3,911,526 | A | 10/1975 | Christy et al. | |
| 4,069,546 | A | 1/1978 | Reichlin | |
| 4,102,005 | A | 7/1978 | Schnarr et al. | |
| 5,517,720 | A | 5/1996 | Anderson et al. | |
| 6,618,899 | B1 | 9/2003 | Ginzel et al. | |

FOREIGN PATENT DOCUMENTS

| | | | |
|---|---|---|---|
| DE | 10348436 | A1 | 6/2005 |
| EP | 0663503 | A1 | 7/1995 |
| JP | 2003184417 | A | 7/2003 |
| JP | 2008128256 | A | 6/2008 |

* cited by examiner

*Primary Examiner*—Chuck Y. Mah
(74) *Attorney, Agent, or Firm*—Cohen Pontani Lieberman & Pavane LLP

(57) ABSTRACT

Closer arm assembly includes a main arm having a first end fixed to the output shaft of a closer fixed to one of a door and a door jamb so that the main arm pivots when the output shaft rotates, and a connecting arm having a first end pivotably connected to the main arm and a second end connected to the other of the door and the door jamb. The connecting arm contacts a stop to limit relative pivoting of the arms, the stop including a cushion with a contact surface which suppresses noise as the connecting arm contacts the cushion. The stop can be in the form of a spring loaded bumper fixed to a soffit plate, or a pin fixed to the second end of the main arm. A hold open device can be fixed to the connecting arm for engaging a feature on either the soffit plate or the main arm, the hold open device having a spring loaded detent which is released by manually turning a knob.

9 Claims, 5 Drawing Sheets

CLOSER ARM ASSEMBLY FOR AN AUTOMATIC DOOR CLOSER

CROSS REFERENCE TO RELATED APPLICATIONS

This application is a divisional of U.S. patent application Ser. No. 11/290,011 which was filed on Nov. 30, 2005, issued as U.S. Pat. No. 7,444,713 on Nov. 4, 2008, the entire content of which is incorporated by reference.

BACKGROUND OF THE INVENTION

1. Field of the Invention

The invention relates to closer arm assembly for a door closer that automatically closes a door hinged to a door jamb, the closer being mounted to one of the door and the door jamb and including an output shaft that rotates to load a spring when the door is opened, the loaded spring providing the motive force for closing the door.

2. Description of the Related Art

Automatic door closers are well known, and typically include a housing which can be mounted to one of the door and the jamb, a piston in the housing, a closer spring which acts on the piston, an output shaft which rotates as the piston moves, and hydraulic channels and valves that regulate the closing movement. The rotation of the output shaft is typically translated to linear movement of the piston by a rack and pinion arrangement. An example is disclosed in U.S. Pat. No. 6,618,899.

Closer arm arrangements include both single arm and double arm arrangements. In a single arm arrangement, one end of the arm is connected to the output shaft of the closer, and the other end is connected to a shoe in a slide track. Double arm arrangements include regular arm, top jamb, and parallel arm. In the regular arm arrangement, the closer is typically mounted on the top of the door on the hinge side (pull side), and the connecting arm is attached to the frame face on the hinge side at a right angle to the door. In the top jamb arrangement, the closer is typically mounted to the frame face on the opposite to hinge side (push side), and the connecting arm is attached to the door on the opposite to hinge side at a right angle to the door. In the parallel arm arrangement, the closer is typically mounted on the top of the door on the opposite to hinge side (push side), and the connecting arm is attached to the door frame so that it is substantially parallel to both the main arm and the door when the door is closed. The arms pivot relative to each other like scissors as the door opens, their relative angle roughly following the angle of the door relative to the frame.

Parallel arm arrangements may include a soffit plate mounted to the soffit of the door frame, and the soffit plate may include a stop in the form of a spring loaded bumper which limits travel of the connecting arm. Known bumpers do not have any cushioning at the contact point with the connecting arm, which results in an undesirable banging noise when the connecting arm hits the bumper. In an arrangement sold by Sargent, the connecting arm contacts a piston which is loaded by a spring in a housing which is only secured by a single bolt. This permits the housing to pivot, but provides only limited resistance to shear stress. U.S. Pat. No. 5,517,720 discloses a bumper having a housing which holds a spring fixed to the soffit plate by a tension pin so that the housing itself makes resilient contact with the connecting arm. Here the tension pin is subject to failure by repeated tensile stress.

Parallel arm arrangements may also include a stop mounted on the end of the main arm, the first end of the connecting arm being pivotably connected to the main arm adjacent to the second end. Here too an undesirable banging occurs when the connecting arm hits the stop.

Door closer arm arrangements may also include a hold open device which maintains the door in an open position with sufficient holding force to resist automatic closing. When the hold open device is engaged, the door may be closed by applying extra force to overcome a spring force in the hold open device. When the device is disengaged (released), the door will close automatically under the force of the spring in the closer.

Known hold open devices typically include a spring-loaded detent in the form of a pin or ball which cooperates with a recess, and is effective between the connecting arm and the soffit plate, or between the two arms at the elbow. A known parallel arm arrangement, sold by Norton Door Controls under the trade name Unitrol, has a fixed pin stop on the main arm and utilizes a holding device including a holding plate having a recess on the main arm, and a housing with a detent loaded by a leaf spring on the connecting arm. The leaf spring is in compression in the engaged position, and requires further compression to release the detent from the socket. Release is achieved by turning a screw a quarter turn against the increasing compression of the leaf spring, which requires using a screw driver.

SUMMARY OF THE INVENTION

The closer arm assembly according to the invention includes a main arm having a first end and a second end, wherein the first end can be fixed to the output shaft so that the main arm pivots when the output shaft rotates; a connecting arm having a first end and a second end, wherein the first end of the connecting arm is pivotably connected to the main arm and the second end of the connecting arm can be pivotably connected to the other of the door and the jamb; and a stop which contacts the connecting arm to limit relative pivoting of the arms. The stop is provided with a cushion that suppresses noise as the connecting arm contacts the cushion. In a bumper type stop mounted to a soffit plate, this cushion may be a UHMW (ultra high molecular weight) nylon button on the end of the spring which is hit by the connecting arm. In a stop at the elbow joint between the main arm and the connecting arm, the cushion may be a urethane sleeve which is fitted on a cylinder mounted for rotation at the second end of the main arm.

The invention also relates to a hold open device that includes a housing fixed to the connecting arm, a plunger extending from the housing for sliding movement through a hole in the connecting arm and into engagement with an engaging feature, a detent which engages the plunger, a hold open spring which loads the detent against the plunger so that the closer cannot automatically close the door when the plunger engages the engaging feature and the hold open spring is compressed, and a release which reduces compression of the hold open spring so that the closer can disengage the plunger from the engaging feature.

The hold open spring is preferably a coil spring, and the release is a bolt which is guided in the housing coaxially with the coil spring. The bolt is movable between a first stable position, wherein the hold open spring is compressed so that the closer cannot automatically close the door when the plunger engages the engaging feature, and a second stable position, wherein the compression of the hold open spring is reduced, so that the closer can disengage the plunger from the engaging feature. Preferably, the bolt is provided with a knob, and can be moved from the second stable position to the first stable position by pushing and turning the knob by hand.

The engaging feature is preferably positioned so that it aligns with the plunger when the connecting arm is against the stop. Where the stop is mounted on a soffit plate, the engaging feature is provided on the soffit plate. Where the stop is provided at the elbow, the engaging feature is preferably provided on a holding plate fixed to the second end of the main arm. While the engaging feature is preferably a recess which is engaged by a convex surface, the engaging feature may also be a convex surface such as an embedded ball, the end of the plunger being provided with a concave mating surface.

In an embodiment having a stop at the elbow, damping of the final stage of opening movement may be provided by a slide track fixed to the door jamb, a shoe which can slide in the track and to which the second end of the connecting arm is pivotably connected, and a spring which can be compressed by the shoe after the stop prevents further relative pivoting of the arms. This arrangement reduces the stress on the stop at the elbow.

The features according to the invention not only reduce noise which results when a door is abruptly opened so that the connecting arm hits the stop, but reduce the stress on components such as the mounts for the stop.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
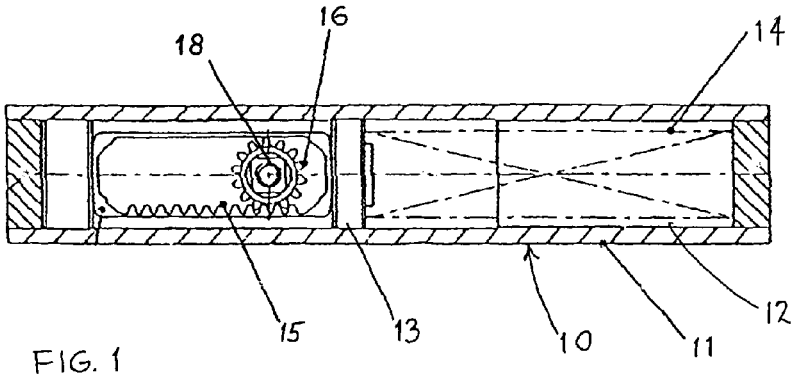
FIG. 1 is a schematic cross-section of an automatic door closer of the type used with a closer arm assembly according to the invention.

The closer arm assembly according to the present invention is designed for use with an automatic door closer of the type shown in cross section in FIG. 1, wherein the closer 10 includes a housing 11 having a cylinder 12 which receives a piston 13. The piston 13 is acted on by closing spring 14 on one side and incorporates a rack 15 on the other side that turns a pinion 16. The pinion 16 is fixed to an output shaft 18 that is journaled in the housing 11 and provides the torque for pivoting an arm to close the door. Other features, such as hydraulic lines and valves that regulate the speed of opening and closing the door, are not germane to the invention and are not shown or further described. Other designs of door closer may also be used with the invention, so long as they include the feature of an output shaft that provides torque to close the door.

Figure 2:
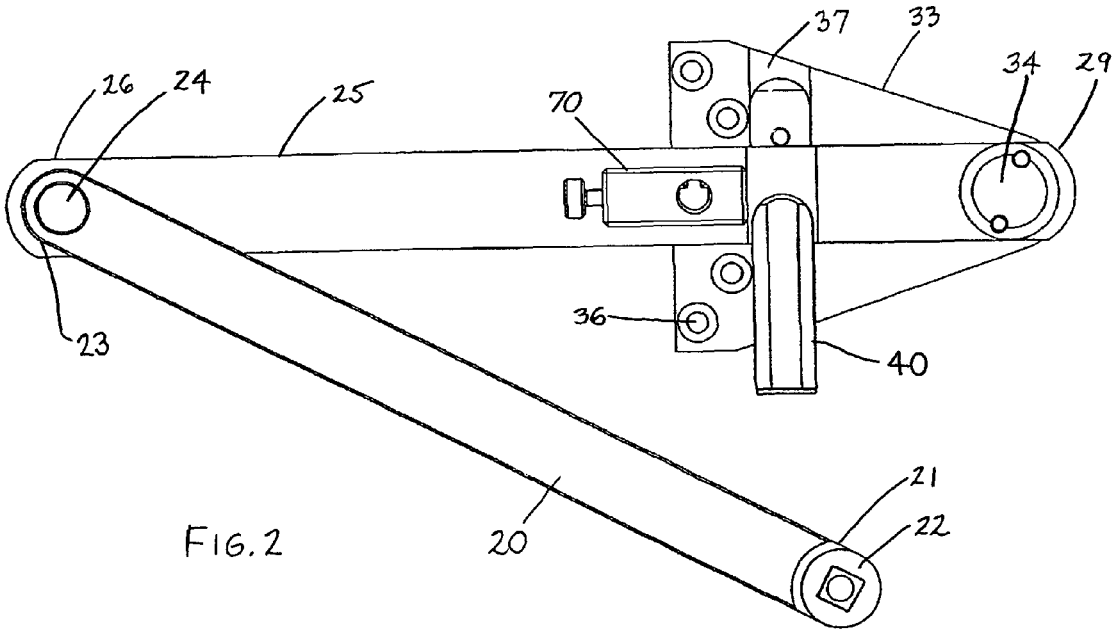
FIG. 2 is a plan view of a first embodiment of closer arm assembly according to the invention.

FIG. 2 shows a closer arm assembly including a main arm 20 having a first end 21 and an opposed second end 23. The first end is provided with a socket 22 which can be fixed nonrotatably to the output shaft 18 of a closer, which typically has a square profile matching the socket. In this case the closer is mounted to a door. The second end 23 is connected to the first end 26 of a connecting arm 25 by a pivot pin 24. The second end 29 of the connecting arm 25 is pivotably connected to a soffit plate 33 at pivot pin 34. The soffit plate 33 is mounted to the soffit of a door frame by screw holes 36, and includes an engaging feature, preferably a recess 35 (FIG. 4), which can be engaged by a hold open device 70 on the connecting arm 25. The soffit plate 33 also has a shallow channel 37 that facilitates the mounting of stop 40.

Figure 3:
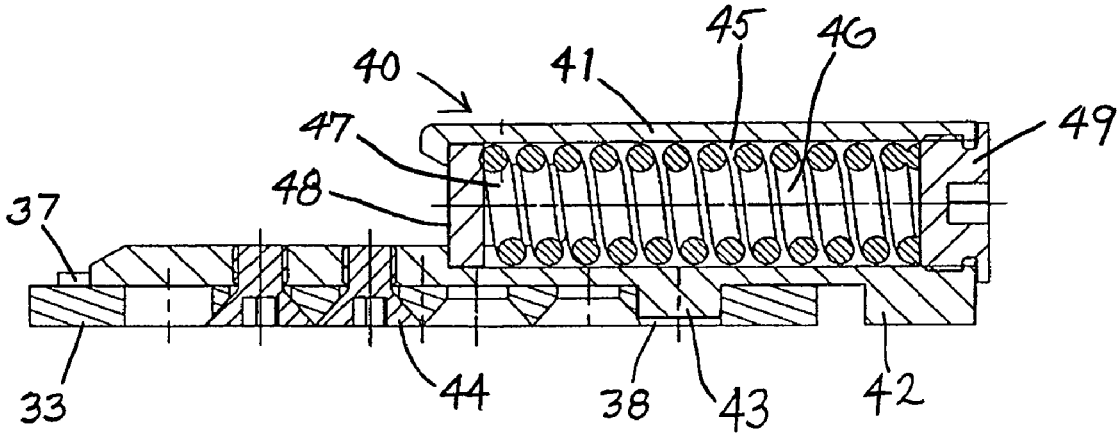
FIG. 3 is a cross-section of the bumper mounted to the soffit plate.

Referring to FIG. 3, the stop 40 includes a housing 41 having a base 42 with a stud 43 that is received in hole 38 in the channel 37. The stop 40 is then secured to the soffit plate 33 by flat head machine screws 44. The housing 41 has a bore 45 that receives a spring 46 having an exposed end 47 fitted with a nylon cushion 48 that abuts a shoulder formed in this end of the bore. The other end of the spring 46 is captured by a plug 49 threaded into the bore 45; the spring 46 can therefore be pre-stressed as the plug 49 is threaded in. In operation, the door swings open and the arms 20, 25 pivot until the connecting arm 25 hits the cushion 48 and compresses the spring 46 to damp the movement. The cushion 48 suppresses contact noise, while the stud 43 and the screws 44 resist shear stress.

Figure 4:
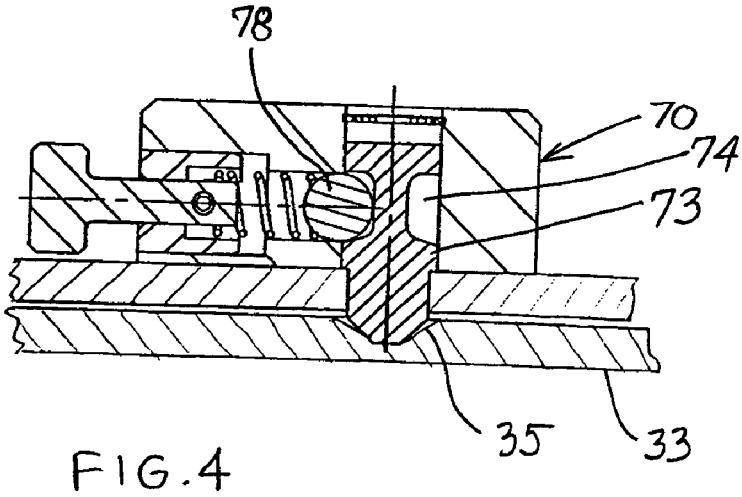
FIG. 4 is a cross-section of the hold open device in FIG. 2.

Referring to FIG. 4, the hold open device 70 contains a plunger 73 which engages a recess 35 in the soffit plate 33 to prevent the closer from automatically closing the door. The plunger has a circumferential recess 74 which is engaged by a spring loaded detent 78 to hold the plunger 73 in the recess 35 against the spring force of the closer, as will be described more fully in conjunction with FIGS. 8A-8C.

Figure 5:
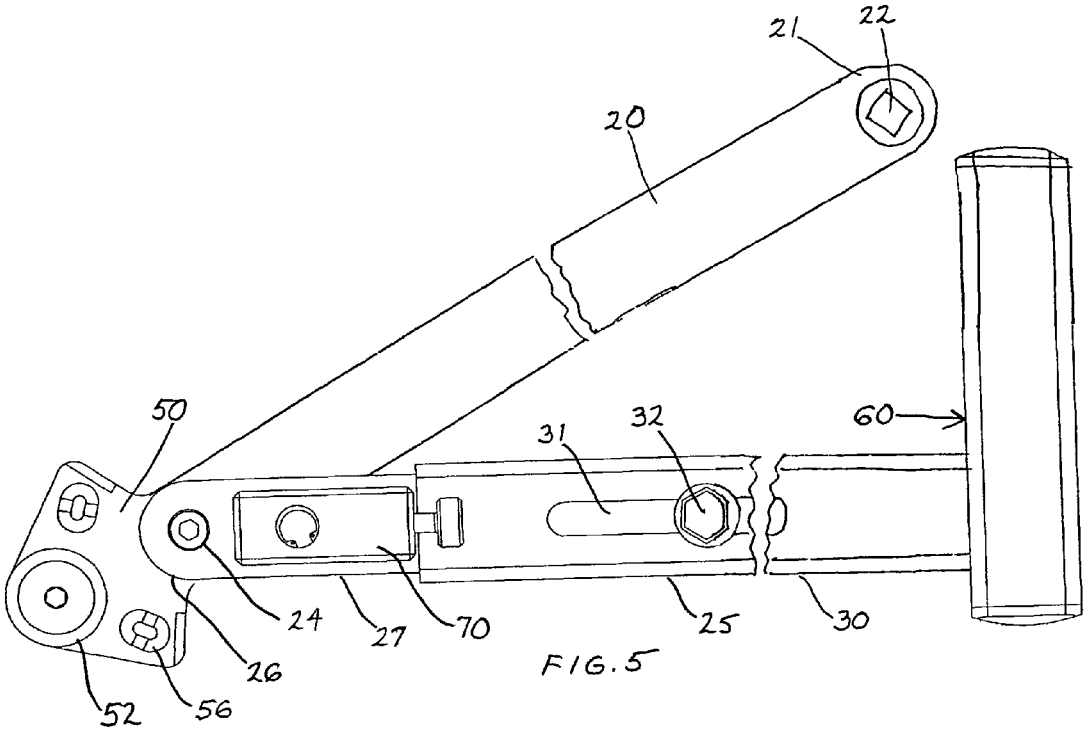
FIG. 5 is a plan view of a second embodiment of closer arm assembly according to the invention.

FIG. 5 shows a second embodiment of closer arm assembly wherein the closer may be mounted to either the door or the door frame. As in the first embodiment, the main arm 20 has a first end 21 provided with a socket 22 for fixing to the output shaft of a closer. However the second end 23 (FIG. 6) is provided with a holding plate 50 to which a stop 52 is fitted; the first end 26 of the connecting arm 25 is connected at pivot pin 24 adjacent to the stop 52. As the door opens, the angle between the arms increases until the connecting arm 25 abuts stop 52, whereupon further relative pivoting of the arms 20, 25 is prevented. The holding plate 50 also has engaging features 56, preferably recesses, which can be engaged by a hold open device 70 on the connecting arm 25 in order to hold the door open against the force of the closer.

The connecting arm 25 can be constructed as a first part 27 that is received in a sleeve-like second part 30 having a slot 31 for a threaded bolt 32. This bolt is screwed into a threaded hole in the first part 27 to permit adjusting the length of the connecting arm 25. The second end 29 (FIG. 7) is pivotably connected to a damper 60 that may be fixed to either the door and the door frame, opposite from the closer.

Figure 6:
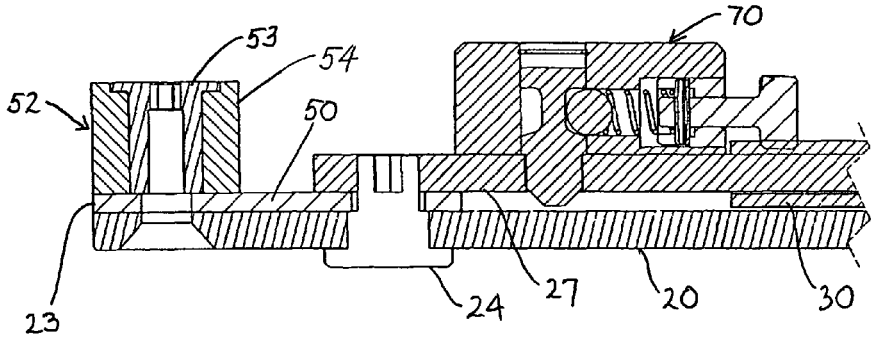
FIG. 6 is a cross-section of the stop and hold open device of FIG. 5.

Referring to FIG. 6, the stop 52 includes a rotatably mounted cylinder 53 fitted with a sleeve 54 of high impact resilient material, such as urethane, which serves as a cushion. Since the sleeve 54 can rotate, the stop 52 is not subject to repeated impact at a single point.

Figure 7:
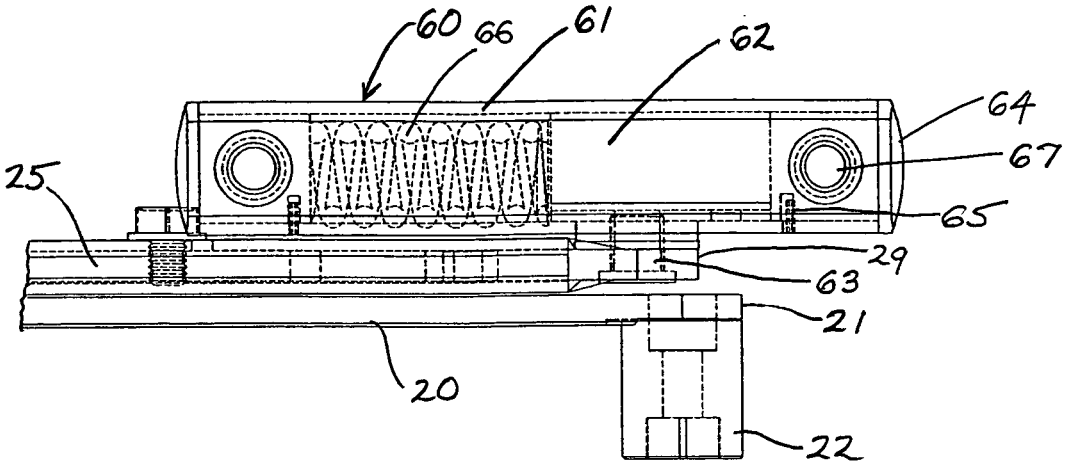
FIG. 7 is a cross-section of the slide channel damper of FIG. 5

As shown in FIG. 7, the damper 60 includes a slide track 61 constructed as a machined channel in which a shoe 62 can slide; the second end 29 of connecting arm 25 pivots on a rivet 63 that is spun riveted to the shoe 62. The ends of the track 61 are blocked by end caps 64 which have mounting holes 67 and are held in place by retaining strips 65. A compression spring 66 is trapped between the shoe 62 and the end cap 64 on the side of the damper toward the door hinge. Thus, when the door is opened until the connecting arm 25 abuts the stop 52 on the main arm 20, the spring 66 will be compressed until movement of the door ceases.

Figure 8A:
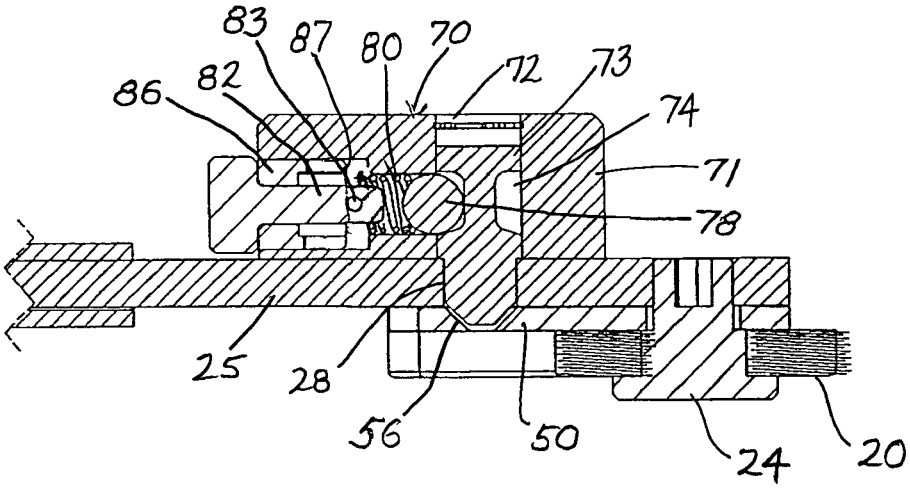
FIG. 8A is a cross-section of the hold open device of FIG. 4 in the engaged position with the spring loaded.

The hold open device 70 shown in FIG. 8A includes a housing 71 having a bore 72 that receives a plunger 73 coaxially with a hole 28 in the connecting arm 25, so that the plunger 73 can engage a recess 56 in the holding plate 50. The plunger 73 has a circumferential recess 74 that is engaged by a spring loaded detent formed by a steel ball 78 and a coil spring 80. A bolt 82 is received through guide 86 in the housing 72. The bolt 82 is fitted with a cross pin 83 which rests on a pair of opposed shoulders 87 to compress the spring when the hold open device is engaged. The shoulders 87 are formed by the inner end of the guide 86.

Figure 8B:
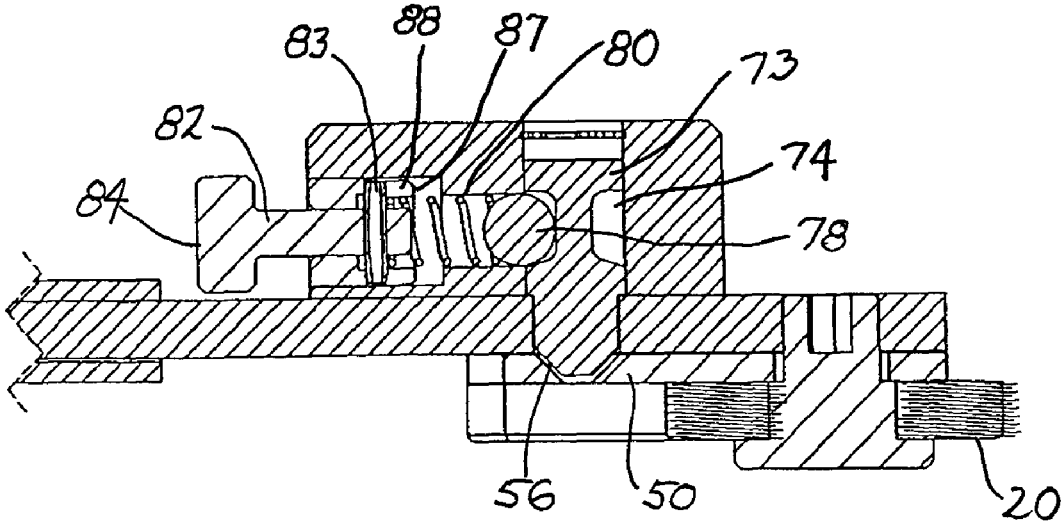
FIG. 8B is a cross-section of the hold open device of FIG. 5 in the engaged position with the spring unloaded.
Figure 8C:
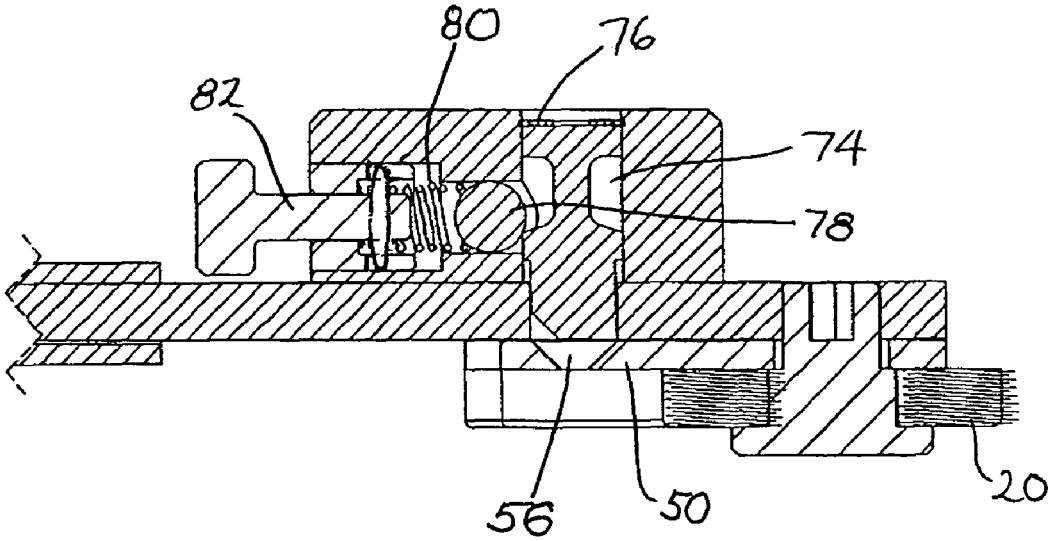
FIG. 8C is cross-section of the hold open device of FIG. 5 in the disengaged position.

FIG. 8B shows the hold open device in the released position, which is achieved by turning a knob 84 on the outer end of bolt 82 until the ends of the cross pin 83 are received in a slot 88 separating the shoulders 87. Since the bolt 82 moves outward under the force of the hold open spring 80, it is only necessary to rotate the knob 84 to effect release. The torque applied to the main arm 20 by the automatic door closer can then overcome the force of the hold open spring 80 so that the plunger can retreat. The circumferential recess 74 is ramped on the side facing the holding plate 50 so that the plunger 73 causes the ball 78 to ride up the ramp and compress the spring 80 to the position shown in FIG. 8C; an internal retaining ring 76 prevents the plunger 73 from coming out of the bore 72. When the end of the plunger 73 clears the holding plate 50, the plunger then snaps back to the position of FIG. 8B.

In order to engage the hold open device, the bolt must be pushed in and turned to get from the configuration of FIG. 8B to the configuration of FIG. 8A. The holding plate 50 is designed so that the plunger 73 is aligned with the recess 56 when the connecting arm 25 is against the stop 52, and the hold open spring 80 is chosen so that it may be compressed by hand pressure and turned without the use a tool. Note that the force of the hold open spring 80 is only sufficient to prevent the door from closing under the force of the automatic closing device; the door may still be closed by manual pressure sufficient to compress the spring further from the state shown in FIG. 8A.

The holding plate has recesses 56 on both sides of the main arm 20, so that the plate 50 can be used in both left-handed and right-handed installations. Typically only one recess is provided on each side of the holding plate, and is aligned with the plunger 73 when the connecting arm 20 abuts the stop 52. Where it is desired to selectively hold the door open in more than one position, more than one recess can be provided on each side of the holding plate.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A closer arm assembly for a door closer which automatically closes a door hinged to a door jamb, the closer comprising a housing which can be mounted to one of the door and the jamb, a piston in the housing, a closer spring which acts on the piston, and an output shaft which rotates as the piston moves, the closer arm assembly comprising:

a main arm having a first end and a second end, wherein the first end is adapted for fixing to the output shaft so that the main arm pivots when the output shaft rotates;

a connecting arm having a first end and a second end, wherein the first end of the connecting arm is pivotably connected to the main arm and the second end of the connecting arm can be pivotably connected to the other of the door and the jamb;

a stop which contacts the connecting arm to limit relative pivoting of the arms, wherein the stop comprises a cushion with a contact surface which suppresses noise as the connecting arm contacts the cushion;

a soffit plate adapted to be fixed to the door jamb, the second end of the connecting arm being pivotably connected to the soffit plate, the stop comprising a housing fixed to the soffit plate and a spring in the housing, the spring having an exposed end, the cushion being fixed to the exposed end; and wherein the housing of said stop is fixed to the soffit plate by at least two screws.

2. The closer arm assembly of claim 1, wherein the cushion is nylon.

3. The closer arm assembly of claim 1, wherein one of the housing of said stop and the soffit plate has a stud, and the other of the housing and the soffit plate has a hole which receives the stud.

4. The closer arm assembly of claim 1, further comprising a releasable hold open device which prevents the door from being closed automatically by the closer, the hold open device comprising an engaging feature on the soffit plate, the connecting arm having a hole which can be aligned with the engaging feature, a housing fixed to the connecting arm over the hole, a plunger extending from the housing for sliding movement through the hole, a detent which engages the plunger, a hold open spring which loads the detent against the plunger so that the closer cannot automatically close the door when the plunger engages the engaging feature and the hold open spring is compressed, and a release which reduces compression of the hold open spring so that the closer can disengage the plunger from the engaging feature.

5. The closer arm assembly of claim 4, wherein the release is a bolt.

6. A closer arm assembly for a door closer which automatically closes a door hinged to a door jamb, the closer comprising a housing which can be mounted to one of the door and the jamb, a piston in the housing, a closer spring which acts on the piston, and an output shaft which rotates as the piston moves, the closer arm assembly comprising:

a main arm having a first end and a second end, wherein the first end is adapted for fixing to the output shaft so that the main arm pivots when the output shaft rotates;

a connecting arm having a first end and a second end, wherein the first end of the connecting arm is pivotably connected to the main arm and the second end of the connecting arm can be pivotably connected to the other of the door and the jamb;

a stop which contacts the connecting arm to limit relative pivoting of the arms, wherein the stop comprises a cushion with a contact surface which suppresses noise as the connecting arm contacts the cushion;

a soffit plate adapted to be fixed to the door jamb, the second end of the connecting arm being pivotably connected to the soffit plate, the stop comprising a housing fixed to the soffit plate and a spring in the housing, the spring having an exposed end, the cushion being fixed to the exposed end; and a releasable hold open device which prevents the door from being closed automatically by the closer, the hold open device comprising an engaging feature on the soffit plate, the connecting arm having a hole which can be aligned with the engaging feature, a housing fixed to the connecting arm over the hole, a plunger extending from the housing for sliding movement through the hole, a detent which engages the plunger, a hold open spring which loads the detent against the plunger so that the closer cannot automatically close the door when the plunger engages the engaging feature and the hold open spring is compressed, and a release which reduces compression of the hold open spring so that the closer can disengage the plunger from the engaging feature.

7. The closer arm assembly of claim 6, wherein the cushion is nylon.

8. The closer arm assembly of claim 6, wherein one of the housing of said stop and the soffit plate has a stud, and the other of the housing and the soffit plate has a hole which receives the stud.

9. The closer arm assembly of claim 6, wherein the release is a bolt.

* * * * *